US006357745B1

(12) United States Patent
Olson

(10) Patent No.: US 6,357,745 B1
(45) Date of Patent: Mar. 19, 2002

(54) COMPETITIVE SKILL GAME

(76) Inventor: Phillip J Olson, 7486 Joy La., Roscoe, IL (US) 61073

( * ) Notice: Subject to any disclaimer, the term of this patent is extended or adjusted under 35 U.S.C. 154(b) by 158 days.

(21) Appl. No.: 09/019,693

(22) Filed: Feb. 6, 1998

(51) Int. Cl.[7] ..... A63F 7/02
(52) U.S. Cl. ..... 273/119 R; 273/129 R
(58) Field of Search ..... 273/108, 118 R, 273/118 A, 119 R, 119 A, 120 R, 120 A, 121 R, 121 A, 123 R, 123 A, 126 R, 126 A, 108.1; 473/203, 551, 516; 2/20

(56) References Cited

U.S. PATENT DOCUMENTS 1,599,188 A * 9/1926 Seede ..... 273/119 R
3,647,215 A * 3/1972 Sterlicchi et al. ..... 273/123 R
3,841,632 A * 10/1974 Schwartz ..... 273/118 R X
3,907,294 A * 9/1975 Breslow ..... 273/126 R X
3,913,918 A * 10/1975 Trachtman ..... 273/126 R
4,017,078 A * 4/1977 Goldfarb et al. ..... 273/126 A
4,146,228 A * 3/1979 Laciste ..... 273/126 R
4,864,660 A * 9/1989 Sawyer ..... 2/20
4,934,024 A * 6/1990 Sexton, I ..... 473/203 X
4,962,929 A * 10/1990 Melton, Jr. ..... 473/551 X
4,998,729 A * 3/1991 Lischerelli ..... 273/118 R X
5,011,147 A * 4/1991 Thomas et al. ..... 473/126 A
5,368,300 A * 11/1994 Becker ..... 273/119 R X
5,467,538 A * 11/1995 Chou et al. ..... 33/508
5,882,007 A * 3/1999 Gay ..... 273/108.1

* cited by examiner

*Primary Examiner*—Raleigh W. Chiu
(74) *Attorney, Agent, or Firm*—Kajane McManus

(57) ABSTRACT

The competitive skill game includes a playing surface upon which any number of a plurality reboundable balls are launched toward and away from a barrier, toward an opponent who attempts a return through use of a paddle, the number of balls in simultaneous play being determined by the desired degree of difficulty for the game.

8 Claims, 2 Drawing Sheets

FIGURE 2
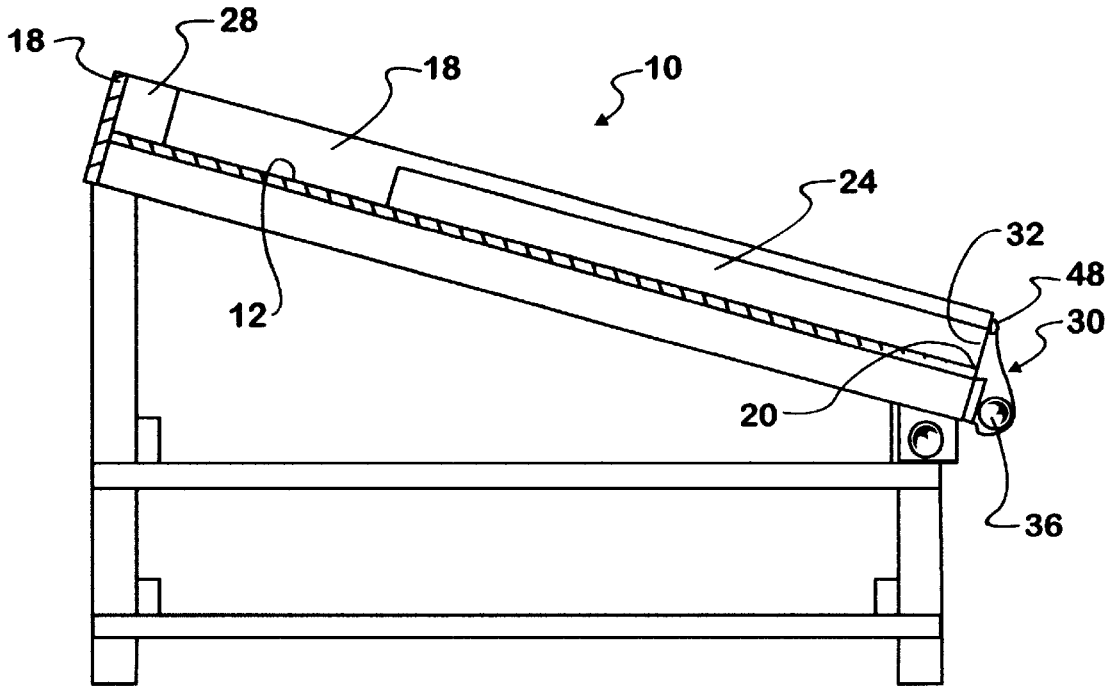
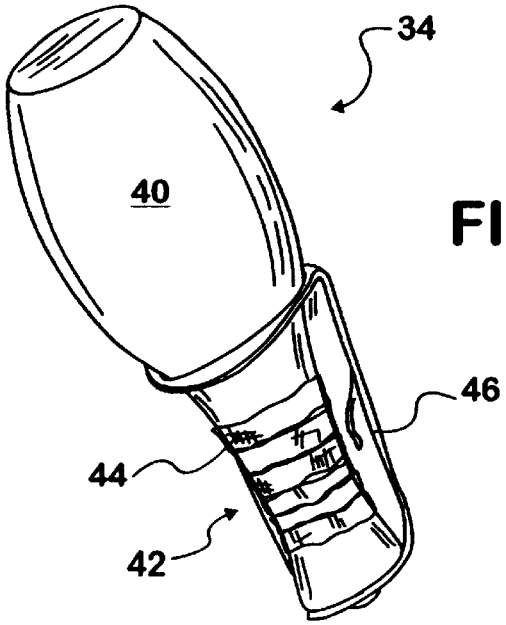
FIGURE 3

COMPETITIVE SKILL GAME

BACKGROUND OF THE INVENTION

1. Field of the Invention

The present invention relates to a competitive game of skill requiring an increasingly high degree of hand-eye coordination, and more particularly to such game where any number of a plurality of balls are in action at any one time, being received and returned by a pair of opponents.

2. Prior Art

Heretofore competitive ball and paddle games have been proposed.

For example, hockey type games are proposed in U.S. Pat. Nos. 3,785,648 and 4,261,568, and a croquet game apparatus is disclosed in U.S. Pat. No. 5,029,863. These games are played on a horizontal surface.

U.S. Pat. No. 4,343,470 discloses a ball rolling game including an inclined ramp centered over a divided catching field with divisions of the field into which the balls fall having various point values.

Further, U.S. Pat. No. 3,907,294 discloses a competitive projectile game having a totally enclosed inclined playing surface wherein a single reboundable ball is launched toward and rebounded from a flexible rebound barrier toward an opposing player using a block like paddle.

SUMMARY OF THE INVENTION

The skill game includes paddle members used to maneuver any desired number of a plurality of reboundable balls from one opponent toward another opponent with the playing surface being inclined toward adjacent play stations at a lower open end of the surface.

Each opponent has one set of up to four or more balls, depending on the desired level of difficulty, and any number of balls may be sequentially launched upon the playing surface and simultaneously played. Play begins when one or both opponents launch a first ball and ceases when either opponent allows a ball to escape the playing surface.

DESCRIPTION OF THE DRAWINGS

FIG. 2 is a cross sectional side view through the game of FIG. 1 and shows one ball captured within a blind pouch at a lower end of the game.

FIG. 3 is an enlarged perspective view of one paddle of the game.

DESCRIPTION OF THE PREFERRED EMBODIMENT

Figure 1:
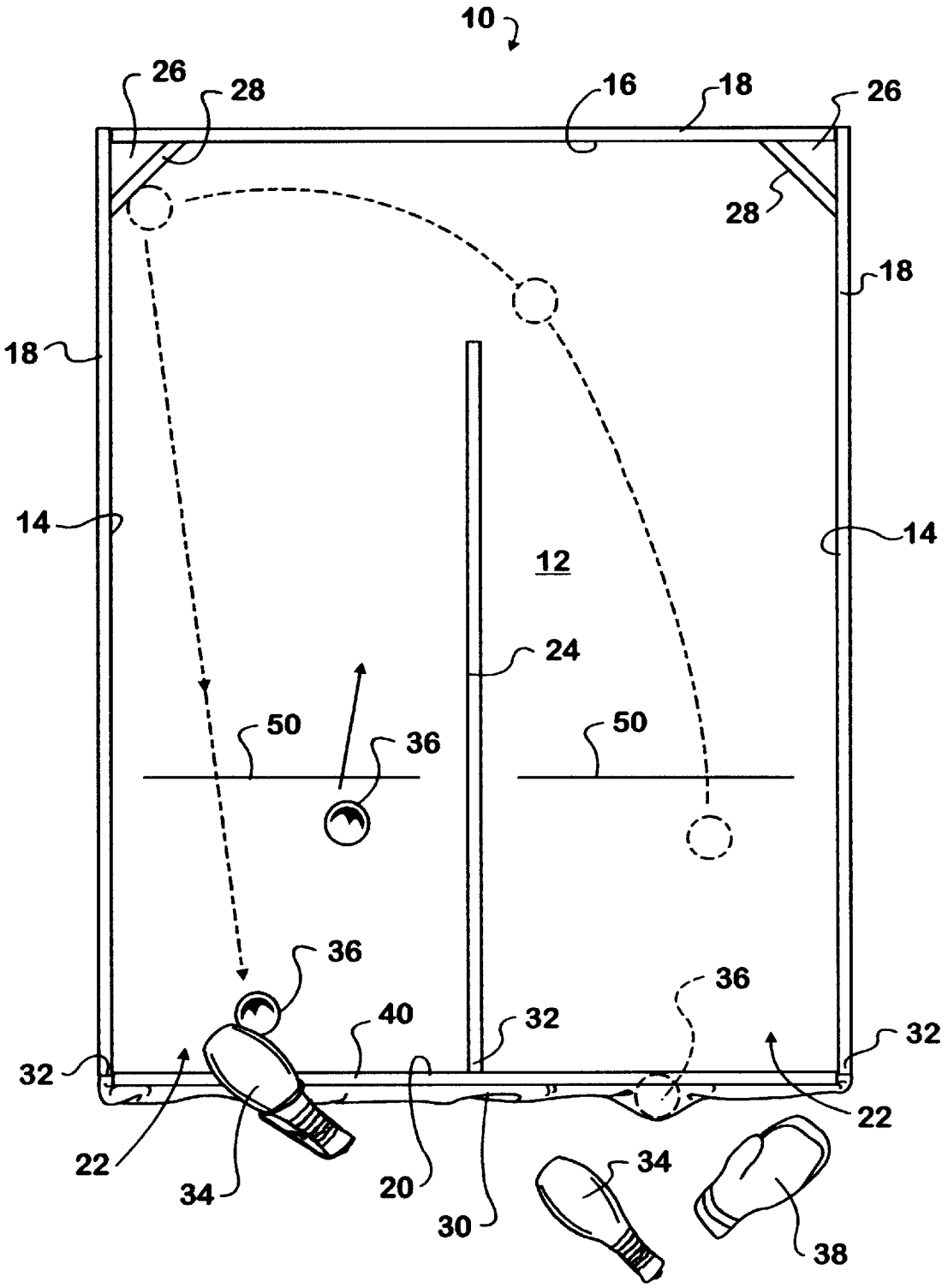
FIG. 1 is a top plan view of the game of the present invention showing two balls in play upon a playing surface of the game.

Referring now to the drawings in greater detail, there is illustrated therein the competitive skill game of the present invention generally identified by the reference numeral 10.

As shown, the game 10 includes an inclined rectangular playing surface 12 which is framed along two elongate sides 14 and an upper end 16 which intersects both sides 14 by an upstanding wall 18. An unframed lower end 20 is open and is divided into two playing stations 22 by means of a centered dividing wall 24 which extends from open end 20 substantially over half way across the surface 12 toward the upper end 16. At each corner 26 defined at each intersection of the upper end 16 with the sides 14, an upstanding barrier

28 is provided which angles across the corner 26 at approximately 45° to the corner 26.

Depending from and fixed to the unframed lower end 20 and extending thereacross is a blind pouch 30 which descends a short distance from the end 20 and then folds back upwardly and outwardly over itself to a predetermined level above the playing surface 12 and is further fixed to free ends 32 of the upstanding wall 18 and centered dividing wall 24 aligned along open end 20.

Each opponent is provided with a paddle 34, a number of balls 36 designated for a particular level of difficulty, and a glove 38 for protecting an opponent's playing hand.

It is preferable to use the glove 38 because the balls 36 are weighty, being similar in weight and size to croquet balls, and further because play is close to the playing surface 12, with the glove 38 protecting the opponent's hand from contact scrapes.

The paddles 34 are themselves rather weighty and are shaped to resemble miniature bowling pins, with a larger ball engaging base 40 extending into a narrower graspable neck portion 42. If desired, the neck portion 42 may be covered with a frictional strip 44 for secure gripping and may further include a strap 46 fixed along the neck portion 42, with the glove 38 sliding between the neck portion 42 and the strap 46 for enhanced grasping security, as best illustrated in FIG. 3.

In play, as shown is FIG. 1, either one or both opponents begin the game by launching a ball 36 toward upper end 16 from one playing station 22 in a manner to rebound the ball 36 toward the opponent's playing station 22. Thus, upstanding wall 18 acts not only to contain the balls 36 upon the playing surface 12 but serves as a primary barrier against which launched balls 36 may be rebounded. Further, each corner barrier 28 may also be used for ball 36 rebound, and is positioned to create an angulation to the rebound path, as shown in FIG. 1, in phantom.

Because the playing surface 12 is downwardly inclined toward the playing stations 22, as best illustrated is FIG. 2, a ball 36 in play will not lose speed as it rebounds toward the playing station 22 to which it is directed and, if launched with sufficient force, will even gain speed after rebounding, as it rolls downwardly, adding a further dimension of challenge to play of the game 10.

It will be understood that anywhere from one to eight (or more) balls 36 may be in play at any given time, based on the desired level of difficulty, with balls 36 being added or launched as either opponent may choose.

Play continues as long as all balls 36 launched remain on the playing surface 12.

If a ball 36 escapes the playing surface 12, it drops and is collected into the blind pouch 30, as shown. Because of the weightiness of the balls 36, and the speed at which they travel, the pouch 30 has been configured as described above to assure that a ball 36 does not contact the body of an opponent standing along the end 20.

To allow for ease of removal of the balls 36 from pouch 30, attachment thereof to the aligned free ends of wall 18 and divider 24 is created using deformable member 48 such as a spring or heavy section of elastic. It will be understood that the deformable member 48 should be elevated above the playing surface 12 sufficiently to assure that a ball 36 cannot escape thereover, as best illustrated in FIG. 2.

It will be seen further that each play station 22 of the playing surface 12 may be provided with a foul line 50, if desired, which defines an area beyond which paddle 34 engagement of the ball 36 by an opponent is not allowed. The foul line 50 is particularly useful in creating an "equalization" of play in an instance where an adult is competing with a child, so that the adult cannot have an advantage of extended reach over that of the child.

As described above, the skill game 10 of the present invention has a number of advantages, some of which have been described above and other of which are inherent on the invention. Also, modifications may be proposed to the skill game 10 without departing from the teachings herein. Accordingly, the scope of the invention should only be limited as necessitated by the accompanying claims.

I claim:

1. A competitive skill game comprising: an inclined playing surface having an upper end and two sides framed by an upstanding wall and an unframed lower end which is open and at which two playing stations are defined; a plurality of reboundable balls; a divider centered between the sides and extending from said unframed lower end substantially more than halfway toward said upper end, and a paddle resembling a small bowling pin for each playing station, said paddle used for launching balls from and returning balls launched to said playing station.

2. The game of claim 1 further including a glove for each playing station.

3. The game of claim 1 further including a blind pouch provided at the lower end for receiving balls therein which leave the playing surface along the end.

4. The game of claim 1 wherein said paddle has a larger ball engaging base and a graspable neck portion.

5. The game of claim 4 wherein said paddle neck portion includes a frictional strip thereon.

6. The game of claim 4 wherein a strap extends along and is fixed to said neck portion.

7. The game of claim 1 further including a foul line for indicating a point beyond which contact between a ball and a paddle cannot be attempted.

8. The game of claim 1 wherein said upper end of said playing surface intersects each side and defines a corner therewith, each corner incorporating an upstanding barrier positioned thereacross at an approximately 45° degree angle thereto.

* * * * *